United States Patent [19]

Wehrell

[11] Patent Number: 4,961,573

[45] Date of Patent: Oct. 9, 1990

[54] BOXING EXERCISE HARNESS

[76] Inventor: Michael A. Wehrell, 2648 Strand, Hermosa Beach, Calif. 90254

[21] Appl. No.: 223,623

[22] Filed: Jul. 25, 1988

[51] Int. Cl.[5] ..... A63B 21/55

[52] U.S. Cl. ..... 272/76; 272/139

[58] Field of Search ..... 272/67, 98, 76, 70 A, 272/106, 135, 137, 140, 139, 138, 142

[56] References Cited

U.S. PATENT DOCUMENTS

| | | | |
|---|---|---|---|
| 475,432 | 5/1892 | Blades | 273/189 R X |
| 712,827 | 11/1902 | Maxwell et al. | 272/139 |
| 1,663,641 | 3/1928 | Smallwood | 272/139 |
| 1,706,654 | 3/1929 | Christesen | 272/137 |
| 1,734,238 | 11/1929 | Sweeney | 272/142 X |
| 2,035,010 | 3/1936 | Rawlings | 272/142 X |
| 4,195,835 | 4/1980 | Hinds et al. | 272/142 |
| 4,318,546 | 3/1928 | Chen | 273/188 R |
| 4,540,173 | 9/1985 | Hopkins, Jr. | 272/139 |

FOREIGN PATENT DOCUMENTS

| | | | |
|---|---|---|---|
| 451516 | 8/1936 | United Kingdom | 272/137 |

*Primary Examiner*—Richard J. Apley
*Assistant Examiner*—H. Flaxman
*Attorney, Agent, or Firm*—Rogers & Killeen

[57] ABSTRACT

A mobile arm, chest, and shoulder exercise apparatus to be used to train and condition participants in sports demanding a high degree of arm speed, endurance, and power. A harness which conforms to the user's upper back and sides and provides a path for elastic cords through a system of pulleys to a position adjacent the user's armpits, where hand grips are attached to the ends of the eleastic cords. When the user grasps the hand grips and directs them away from the harness, the resistive force of the elastic cords is transferred to the user's arms, thereby providing a relatively constant resistive force directed toward the armpits for strengthening the arms, chest, and shoulders. Generation of a nearly constant force is accomplished by directing one or more of the elastic cords to the rear of the apparatus, thereby allowing for the use of an increased length of cord. The apparatus may be adjusted to fit the physical dimensions of the user, and the resistive force may be varied to fit the needs of the user.

21 Claims, 7 Drawing Sheets

BOXING EXERCISE HARNESS

BACKGROUND OF THE INVENTION

The present invention relates to a mobile arm, chest, and shoulder exercise apparatus for training and conditioning participants in sports activities that call for highly developed hand speed and power. For example, it may be used in the sport of boxing to simultaneously improve punching power, punching endurance, and hand speed of boxers.

Hand speed, punching power, and endurance are three vital qualities a boxer must have to remain competitive. Various mobile devices worn by the user to improve one or more of these qualities have been proposed. Some of these devices are not adjustable to fit users of diverse body dimensions, and thus may be uncomfortable to wear and inefficient to use at extreme body sizes. The apparatus disclosed in Piscitelli U.S. Pat. No. 1,402,179, dated Jan 3, 1922, for example, includes an unadjustable back and shoulder harness. Similarly, the device disclosed in Berger U.S. Pat. No. 4,645,204, dated Feb. 24, 1987, is not adjustable.

Other proposals to improve boxing performance do not include a resistive force that is nearly constant throughout a predetermined range of motion. To provide relatively constant resistance, the effective length of the elastic cords must be increased whereby the change in length of the elastic cord during exercise is small compared to the unextended length of the elastic cord. The devices in Blake U.S. Pat. No. 1,432,013, dated Oct. 17, 1922; Bosch U.S. Pat. No. 4,441,707, dated Apr. 10, 1984; and in the above-referenced Piscitelli patent have elastic cords that are too short to provide a nearly constant resistive force.

Further, such proposals do not direct the force opposing motion of the arm toward the user's armpit. As seen in FIG. 1, in the prior art (see, for example, the devices in the Piscitelli, Blake, and Berger patents) the focus of the forces at natural exercise positions such as points D, E, and F is the back adjacent the shoulder blades at point Y. Resistance to motion of the arm thus comes from an unnatural location, reducing the comfort and efficiency of the exercise. In addition, an arm in position G is subjected to a force vector tending to direct the arm rearward (direction H).

As will be shown, the present invention focuses the forces in a more natural position under the shoulder joint adjacent the armpit. This is seen in FIG. 2 wherein point X is the focus of the forces at exercise positions A, B, and C. Further, the rearward force has been eliminated when the arm is in location I.

The proposals to improve boxing performance in the above-referenced art also do not include resistive forces that are adjustable without modifying or removing the components of the devices, nor do they include provisions for reducing resistance due to undesirable frictional forces in the device itself and those resulting from the elastic cords rubbing directly against the user.

Accordingly, it is an object of the present invention to provide a mobile shoulder, arm, and chest exercise apparatus that obviates the problems of the prior art.

It is another object of the present invention to provide an exercise harness that places the point of origin of all force vectors of the elastic cords under the shoulder joint adjacent the armpit.

It is yet another object of the present invention to provide a novel mobile upper body exercise harness that provides a nearly constant resistive force that may be adjusted by the user while wearing the harness without interchanging or detaching any parts of the harness.

It is yet a further object of the invention to provide a comfortable harness for routing the elastic cord so that the cord does not contact the user's torso or any non-moving parts of the harness during normal exercise motions.

It is still a further object of the present invention to provide a mobile boxing exercise harness that is adjustable to conform to a wide variety of sizes of users' upper backs, chests, and sides.

These and many other objects and advantages will be readily apparent to one skilled in the art to which the invention pertains from a perusal of the claims and the following detailed description of preferred embodiments when read in conjunction with the appended drawings.

THE DRAWINGS

DETAILED DESCRIPTION OF PREFERRED EMBODIMENTS

Figure 1:
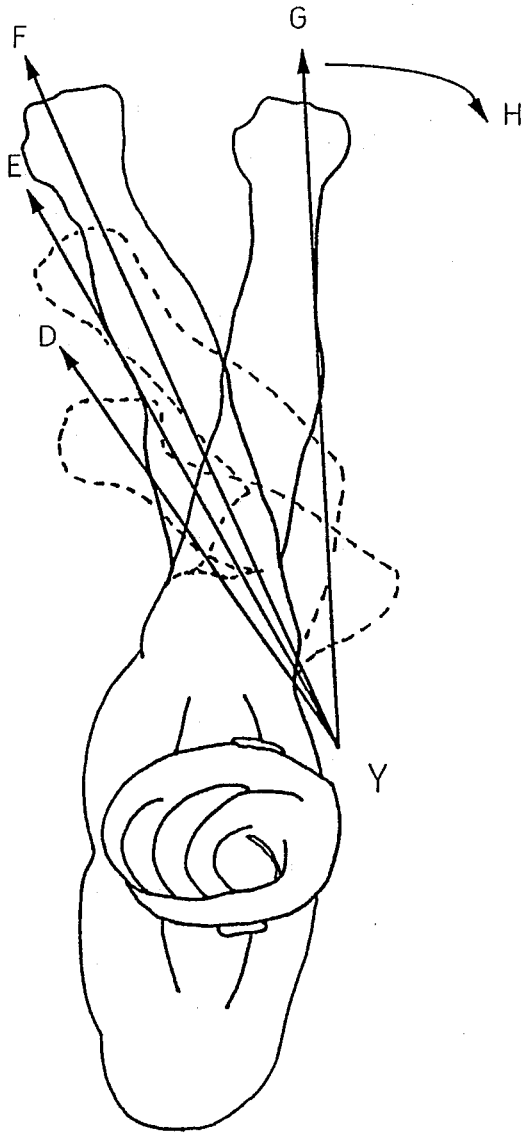
(PRIOR ART) FIGURE 1
FIG. 1 is a pictorial representation of the force vectors encountered in prior art exercise devices as seen from overhead a user.
Figure 2:
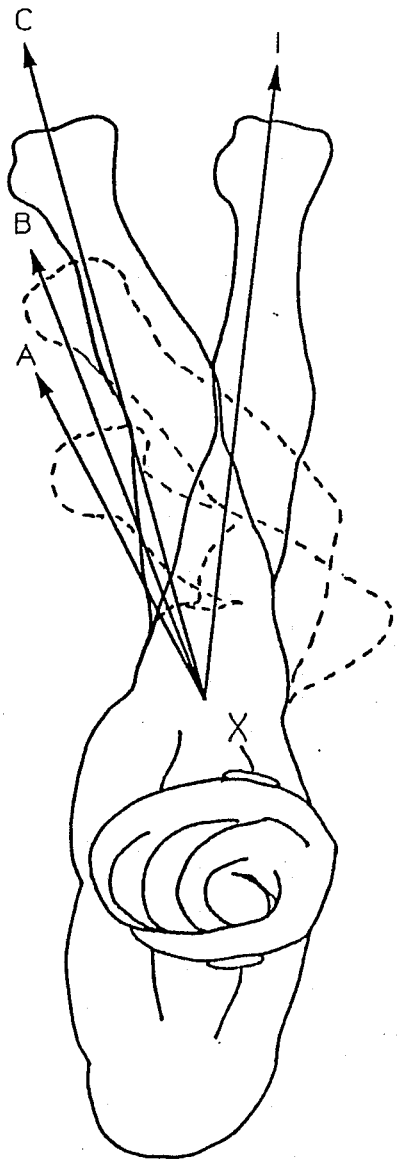
FIG. 2 is a pictorial representation of the force vectors encountered in the present invention as seen from overhead a user.

With reference to the figures where like elements have been given like numerical designations to facilitate an understanding of the present invention, and particularly with reference to the embodiment of the boxing exercise harness of the present invention illustrated in FIGS. 3–7, the boxing exercise harness may be constructed of underarm members 20 connected to back member 40 with hinges 100, grasping means 60 attached to elastic member 80, low friction members 120 attached to the back member 40, and shoulder straps 140 and chest straps 160 for retaining the boxing exercise harness on the human torso.

Figure 3:
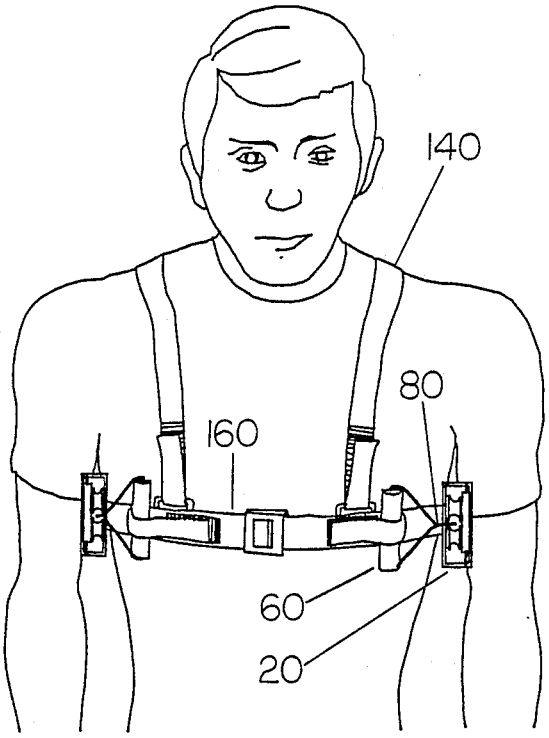
FIG. 3 is a front view of a pictorial representation of an embodiment of the present invention with the harness fitted to the user's torso.
Figure 4:
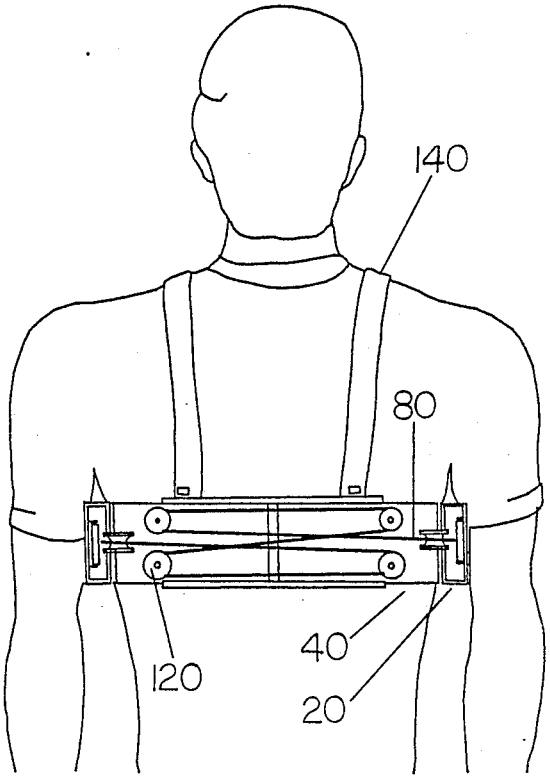
FIG. 4 is a rear view of a pictorial representation of the embodiment of the invention seen in FIG. 3.
Figure 5:
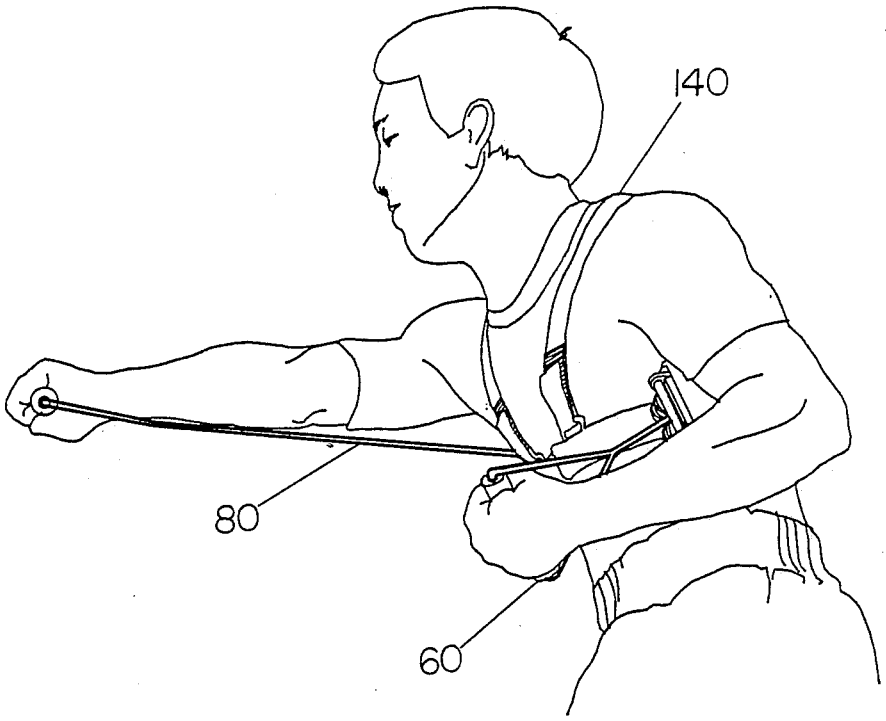
FIG. 5 is a pictorial representation of a side view of a user performing a punching motion using the embodiment of the present invention seen in FIG. 3.

As may be more clearly seen in FIGS. 3–5, the boxing exercise harness of the present invention is worn on the upper torso with the back member 40 positioned on the upper back so that connecting underarm members 20 extend to the armpits of the user. Grasping means 60 held in the hands of the user during exercise, and elastic member 80 provides a resistive force to oppose arm motion of the user such as seen in FIG. 5.

Figure 6:
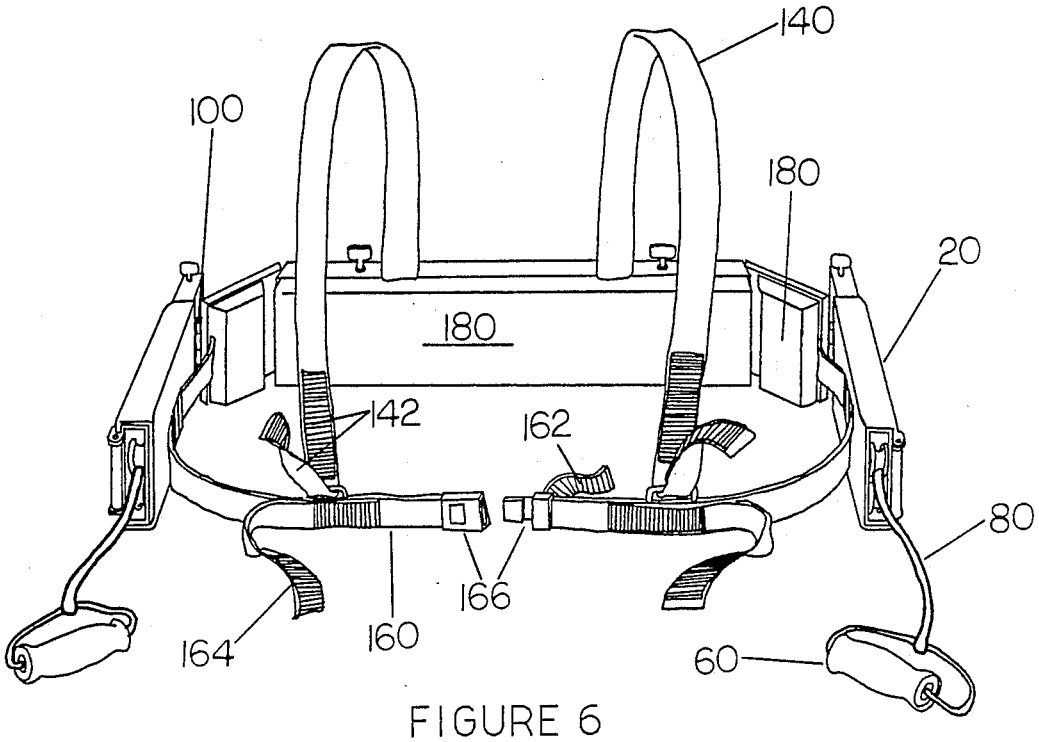
FIG. 6 is a pictorial representation of the embodiment of the present invention seen in FIG. 3 showing the harness removed from the user.

As may be more clearly seen in FIG. 6, the boxing harness of the present invention is retained on the user's torso with shoulder straps 140 that may have adjusting means such as VELCRO pads 142. The chest strap 160 may also be adjustable with adjusting means such as VELCRO adhesive pads 162. The chest strap is released with clasp 166. The chest strap 160 may also include means to carry the grasping means 60 when not in use, such as straps 164, which also may have VELCRO adhesive pads. The harness may also include suitable padding 180 on the back member and side members to prevent chaffing during use.

Figure 7:
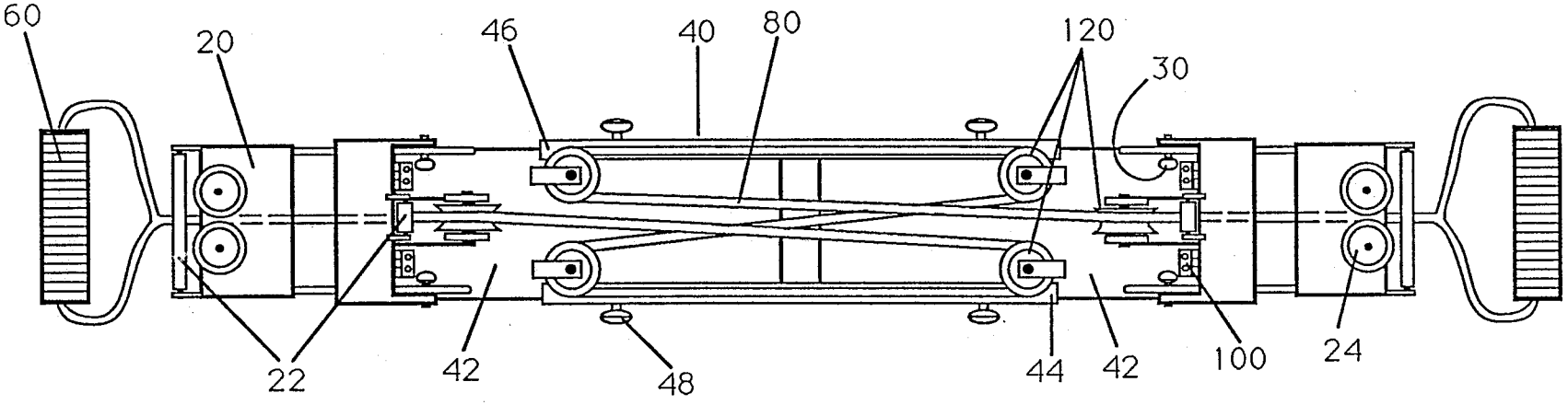
FIG. 7 is a pictorial representation of the rear view of the embodiment of the present invention seen in FIG. 6 (straps removed for clarity).

The back member 40 may be seen more clearly in FIG. 7. It should be constructed of lightweight material and may include rigid or semi-rigid plates 42 to hold low friction members 120 in position. The plates 42 may be flat or, as may be seen in FIG. 8, shaped to conform to the back of a user. The plates 42 may be slidably mounted in a frame 44 that has suitable means to receive the plates 42, such as grooved railings 46 on the edges of the frame. The frame may include hand-operated wing nuts to hold the plates 42 in the frame 44 and at a position that is most comfortable for the user. In operation, the user adjusts the size of the back member by loosening the wing nuts 48 and sliding the plates 42 until the distal ends of the back member extend to a position adjacent the armpits of the user.

Figure 8:
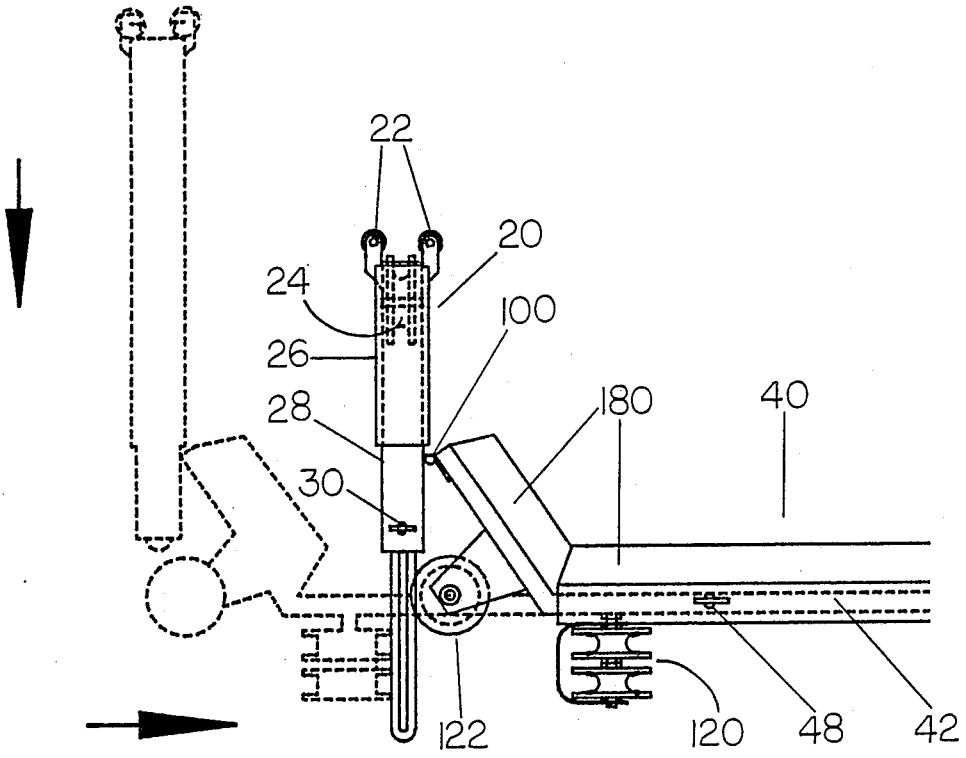
FIG. 8 is a partial pictorial representation of a top view of the embodiment of the present invention seen in FIG. 7 (cords and straps removed for clarity) showing the adjustment of the back and underarm members.

The low friction members 120, which may be pulleys or similar low friction devices to change the direction of a moving cord, form a path for the elastic member 80. The path should be long enough to create a nearly constant resistive force in the elastic member 80 when the harness is used during exercise. While FIG. 7 illustrates a particular path for the elastic member 80, it should be understood that any suitable path may be used. The path should be arranged so that the elastic member 80 does not rub against the nonmoving part of the back member 40 or against itself. As seen in FIG. 8, low friction members 122 should be provided in a position to direct the elastic member 80 away from the back member 40 to the underarm members 20.

Underarm members 20 may be seen in FIGS. 7 and 8. Like the back member 40, they should be lightweight, but they need not have the rigidity of the plates 42 in the back member. They may be connected to the back member 40 with a hinge 100 to allow movement during use and to facilitate tracking of the elastic cord during extreme direction changes of the cord. The underarm members 20 include means to track the elastic member and to hold it in place under the arms. Roller bearings 22 and pulleys 24 have been provided in this embodiment for that purpose. The underarm members 20 may also be adjustable to conform to the size of the chest of the user. To that end, the members 20 may include an outer frame 26 slidably mounted on an inner frame 28. The outer frame 26 contains pulleys 24 and a set of bearings 22. The inner frame 28, which may also contain bearings 22, is attached to the hinge 100. Hand-operated wing nuts 30 may be provided to hold the inner and outer frames in position. The underarm members may also be padded (not shown) and may include plural hinged submembers.

The adjustability of the harness is seen in FIG. 8 wherein a harness adjusted to fit a small user is shown in solid lines and a harness adjusted for a large user is shown in dashed lines.

The elastic member 80 may be an elastic cord such as shockcord. Its unextended length should be sufficiently greater than the change in length encountered during normal use so as to create a nearly constant resistive force.

Figure 9:
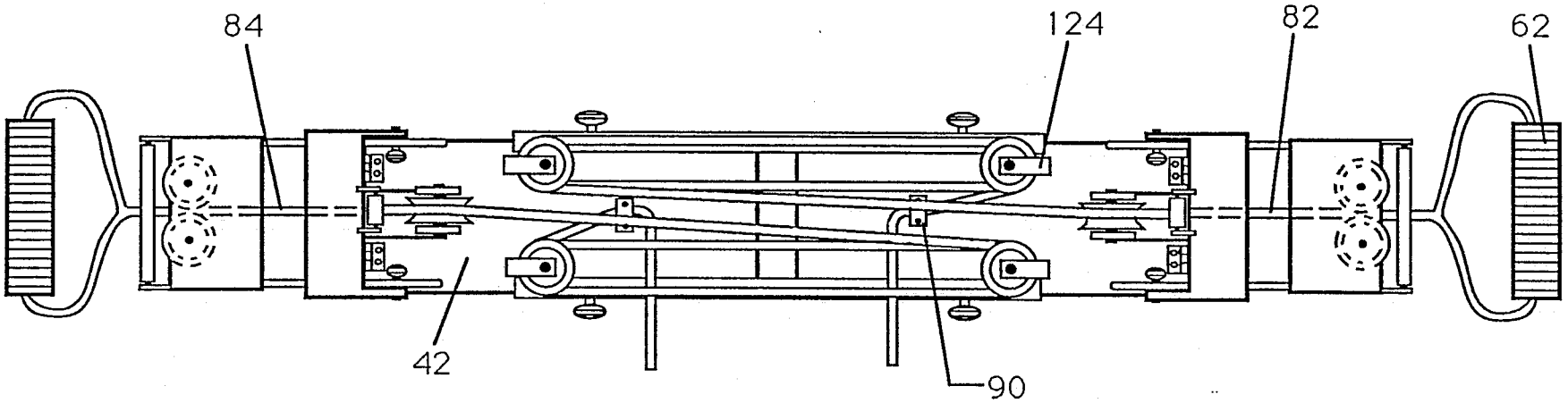
FIG. 9 is a partial pictorial representation of the rear view of an embodiment of the present invention having an adjustable resistive force in the elastic member.

The resistive force of the elastic member 80 may also be made selectively adjustable by changing the resting tension in the elastic member. As seen in FIG. 9, this embodiment includes two elastic cords 82 and 84, each having an end attached to a grip 62. (For clarity, cord 84 is not illustrated. It is identical to cord 82.) The opposite ends of the cords 82 and 84 are unattached. The path for each cord is formed by pulleys 124. To make the resistive force adjustable, the unattached ends of the elastic cords may be releasably clamped with cleats 90. The user may adjust the resting tension by pulling or releasing the unattached ends of cords 82 and 84 without removing the harness. A suitable receptacle for the loose portion of the unattached ends of the cords, such as a bag with suitable means to hold it to the torso, may be provided. The cleats 90 may include means to releasably lock the elastic cords 82 and 84 in place and means to direct the cords away from the back member to avoid entanglement.

Figure 10:
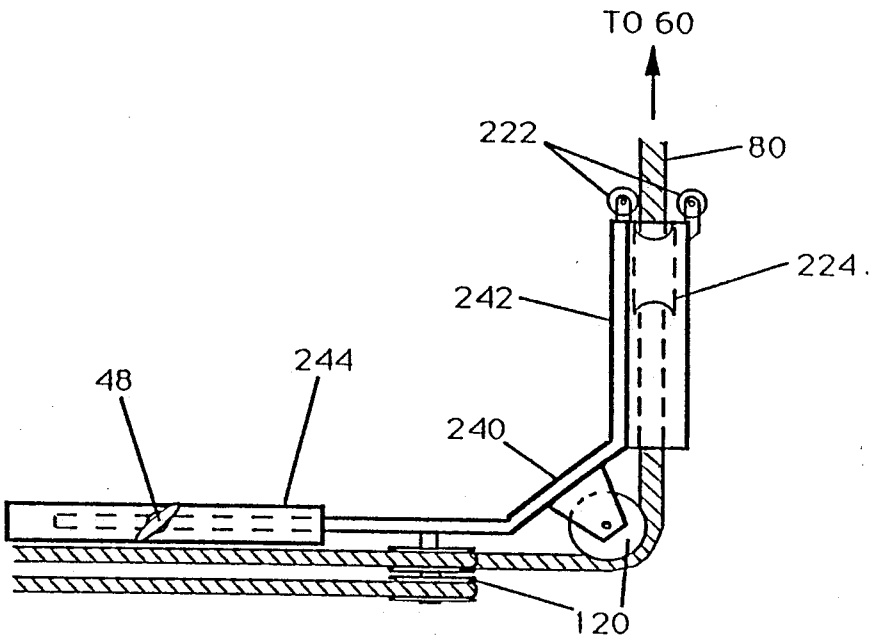
FIG. 10 is a partial pictorial representation of the top view of an embodiment of the present invention without separate underarm members.

In another embodiment, the harness of the present invention may include a back member that extends under the shoulder of the user, eliminating the separate underarm members. As seen in FIG. 10, the harness of this embodiment includes a back member 240 having a rigid or semi-rigid frame 244 that slidably receives plates 242. Plates 242 are shaped to conform to the back and sides of the user. Low friction members 120 create a path for the elastic member 80. Roller bearings 222 and pulleys 224 track cord movement during use.

While the preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

What is claimed is:

1. An exercise harness comprising:

a back member with means for attachment to the back of a user, said back member having a rigid frame and plural plates slideably connected to said rigid frame for adjusting the end-to-end length of said back member to conform to the armpit-to-armpit width of the back of a user;

two underarm members hingedly connected to the distal ends of said back member, each of said underarm members having means to adjust its end-to-end length to conform to the back-to-armpit width of the side of a user;

two hand grips extending forwardly from said underarm members;

one or more elastic members each having at least one distal end affixed to one of said grips for providing a force opposing movement of said grips, said elastic members having a length whereby said force is relatively constant over a predetermined range of motion of said grips; and plural low friction members affixed to said back and underarm members forming a path for said elastic members, said path having an end adjacent the armpit of a user, whereby said force is directed toward the armpit of a user.

2. The exercise harness as defined in claim 1 further comprising means for adjusting said force wherein said force is adjustable by a user while wearing the harness.

3. The exercise harness as defined in claim 1 wherein each said means to adjust the end-to-end length of said underarm member comprises plural movably connected submembers.

4. The exercise harness as defined in claim 1 further comprising plural straps carried by said back member for the shoulders and chest for removable attachment to the human torso.

5. The exercise harness as defined in claim 4 further comprising means for removably attaching said grips to said straps when said grips are not in use.

6. An exercise harness comprising:

a rigid back member with means for attachment to the back of a user, said back member having means for adjusting the end-toend length of said back member to reach under the armpits of a user; and elastic means carried by said back member and extending forwardly from a distal end of said back member for providing a force opposing exercise movement, whereby said force is directed toward the armpit of a user.

7. The exercise harness as defined in claim 6 wherein said back member comprises plural hingedly connected rigid underarm members for reaching under the armpits of a user.

8. The exercise harness as defined in claim 6 further comprising means for adjusting said force wherein said force is adjustable by a user while wearing the harness.

9. A boxing exercise harness comprising:

a back member with means for attachment to the back of a user, said back member comprising plural underarm members hingedly connected to a rigid frame adapted to be worn on the back of a user, said frame having plural plates slideably attached thereto for adjusting the end-to-end length of said back member; and an elastic member carried by said back member extending forwardly from the distal ends of said back member and grasped by a user for providing a relatively constant force opposing a jabbing exercise movement by a user grasping said elastic member.

10. The boxing exercise harness as defined in claim 9 further comprising plural low friction members affixed to said back member forming a path for said elastic member.

11. The boxing exercise harness as defined in claim 10 further comprising means for adjusting said force whereby said force is adjustable by a user without replacing any member of the harness.

12. In a boxing exercise harness having a back member with means for attachment to the back of a user and an elastic member carried by said back member providing a force opposing a jabbing motion, the improvement comprising means for adjusting the end-to-end length of said back member to conform to the width of the back of a user and for locating the distal ends of said back member under the armpits of a user whereby said elastic member extends from the armpits of a user over the range of adjustments of the end-to-end length of said back member.

13. The boxing harness as defined in claim 12 further comprising the improvement wherein said elastic member has a length whereby said force is relatively constant over the range of said jabbing motion.

14. The exercise harness as defined in claim 1 wherein said elastic member has each of its distal ends affixed to a different one of said two grips.

15. The exercise harness as defined in claim 1 further comprising a second said elastic member having a distal end affixed to one of said grips.

16. The exercise harness as defined in claim 15 further comprising one or more cleats for releasably adjusting said force wherein said first and second elastic members each have a free distal end extending through said cleats.

17. The exercise harness as defined in claim 1 wherein said low friction members comprise pulleys.

18. The exercise harness as defined in claim 6 wherein said elastic means has a length whereby said force is relatively constant over the range of motion of said exercise movement.

19. The exercise harness as defined in claim 17 wherein said back member further comprises plural pulleys for providing a path for said elastic means, said path having ends under the armpits of a user.

20. The exercise harness as defined in claim 3 wherein said submembers telescope to adjustably fit diverse chest thicknesses.

21. A boxing exercise harness comprising:

a rigid back member with means for attachment to the back of a user, said back member having means for adjusting the end-to-end length of said back member;

two submembers, each said submembers being hingedly connected to a distal end of said back member and having means for adjusting the end-to-end length of said submembers; and elastic means carried by said back member and extending from the free distal ends of said submembers for providing a force opposing exercise movement, wherein said force is directed toward a point on a user that may be adjusted with said means for adjusting said back member and said submembers.

* * * * *